US009074399B2

(12) United States Patent
Cheng

(10) Patent No.: US 9,074,399 B2
(45) Date of Patent: Jul. 7, 2015

(54) HYDRAULIC HINGE FOR A GLASS DOOR

(71) Applicant: GANG GWO INDUSTRIAL CO., LTD., Pingtung, Pingtung County (TW)

(72) Inventor: Ko-Ming Cheng, Pingtung (TW)

(73) Assignee: GANG GWO INDUSTRIAL CO., LTD., Pingtung, Pingtung County (TW)

( * ) Notice: Subject to any disclaimer, the term of this patent is extended or adjusted under 35 U.S.C. 154(b) by 40 days.

(21) Appl. No.: 13/905,739

(22) Filed: May 30, 2013

(65) Prior Publication Data

US 2014/0352108 A1 Dec. 4, 2014

(51) Int. Cl.

| | |
|---|---|
| ***E05F 3/20*** | (2006.01) |
| ***E05F 3/10*** | (2006.01) |
| *E05D 5/02* | (2006.01) |
| *E05F 3/12* | (2006.01) |

(52) U.S. Cl.

CPC ..... *E05F 3/104* (2013.01); *Y10T 16/2771* (2015.01); *E05D 5/0246* (2013.01); *E05F 3/12* (2013.01)

(58) Field of Classification Search

CPC ..... E05F 3/20; E05D 5/0246
USPC ..... 16/54, 55, 56, 58, 59, 60, 274, 277, 16/309, 312, 378
See application file for complete search history.

(56) References Cited

U.S. PATENT DOCUMENTS

| | | | | |
|---|---|---|---|---|
| 2,701,383 | A * | 2/1955 | Billeter | 16/59 |
| 4,937,913 | A * | 7/1990 | Jentsch | 16/58 |
| 7,010,832 | B2 * | 3/2006 | Chen | 16/252 |
| 8,443,487 | B2 * | 5/2013 | Bacchetti | 16/51 |
| 8,528,169 | B1 * | 9/2013 | Yu | 16/51 |
| 8,578,557 | B2 * | 11/2013 | Yu | 16/55 |
| 8,677,560 | B2 * | 3/2014 | Bacchetti | 16/51 |
| 8,720,005 | B2 * | 5/2014 | Cheng | 16/54 |
| 8,782,953 | B2 * | 7/2014 | Bongiovanni | 49/239 |
| 2008/0034535 | A1 * | 2/2008 | Chiang | 16/60 |
| 2010/0319265 | A1 * | 12/2010 | Theisen | 49/388 |
| 2012/0311817 | A1 * | 12/2012 | Bacchetti | 16/51 |
| 2013/0185896 | A1 * | 7/2013 | Yu | 16/55 |

* cited by examiner

*Primary Examiner* — Emily Morgan
(74) *Attorney, Agent, or Firm* — Muncy, Geissler, Olds & Lowe, P.C.

(57) ABSTRACT

A hydraulic hinge for a glass door has a fixing plate, a rotating seat, a pivot and a buffer module. The rotating seat is combined with the fixing plate and has a first oil passage and a second oil passage. The pivot is combined with the fixing plate and the rotating seat. The buffer module is mounted in the rotating seat and has a valve having a circular groove selectively communicating with the second oil passage. A glass door can be pivoted relative to the rotating seat. The valve is structurally simple, thereby simplifying the manufacturing process. With the valve and the second oil passage, the velocity of closing the glass door gradually increases from low speed to high speed.

8 Claims, 11 Drawing Sheets

HYDRAULIC HINGE FOR A GLASS DOOR

BACKGROUND OF THE INVENTION

1. Field of the Invention

The present invention relates to a hydraulic hinge, especially for a hydraulic hinge for a glass door.

2. Description of Related Art

A glass door is pivotally mounted on a doorframe by a hydraulic hinge. A conventional hydraulic hinge has a fixing plate, a rotating seat, a pivot and a buffer module. The fixing plate is mounted on the doorframe. The rotating seat is mounted on the glass door and has an oil chamber for storing oil and an oil passage communicating with the oil chamber. The pivot has a first portion, a second portion and an eccentric cam. The first portion of the pivot is mounted on the fixing plate and the second portion of the pivot is mounted into the rotating seat. The eccentric cam is located in the rotating seat. The buffer module is mounted on the rotating seat and is located in the oil chamber of the rotating seat. The buffer module has a valve and a spring. The valve has a through hole for receiving the pivot and a fixing element for abutting against the eccentric cam. The valve has a recess communicating with the through hole and the oil passage, a first oil hole and a second oil hole. The first oil hole and the second oil hole communicate with the recess and the oil chamber. The spring abuts against the rotating seat and the valve.

When the glass door is pivoted, the rotating seat is rotated relative to the fixing plate. The eccentric cam of the pivot abuts the fixing element of the valve for controlling the valve to press the spring and drive oil in the oil chamber. However, the valve is structurally complex, thereby complicating the manufacturing process. Additionally, the rotating seat provides only a single oil passage, so the glass door is closed slowly such that cool air generated by an air-conditioner escapes from the house.

To overcome the shortcomings, the present invention provides a hydraulic hinge to mitigate or obviate the aforementioned problems.

SUMMARY OF THE INVENTION

The main object of the present invention is to provide a hydraulic hinge for a glass door; the hydraulic hinge has a fixing plate, a rotating seat, a pivot and a buffer module.

The rotating seat has a body, an oil chamber, a first oil passage and a second oil passage. The oil chamber, the first oil passage and the second oil passage are formed in the body. The first oil passage has a first inlet and a first outlet. The first inlet and the first outlet are in communication with the oil chamber respectively. The second oil passage has a second inlet and a second outlet. The second inlet is in communication with the first oil passage. The second outlet is in communication with the oil chamber and is disposed between the first inlet and the first outlet.

The pivot is combined with the fixing plate and the rotating seat, and has a first portion, a second portion and an abutted surface. The first portion is mounted steadily on the fixing plate. The second portion is opposite to the first portion and is mounted rotatably into the rotating seat. The abutted surface is formed on the pivot and is located in the oil chamber of the rotating seat. The abutted surface is flat.

The buffer module is mounted in the rotating seat and is located in the oil chamber of the rotating seat and has a valve and a spring. The valve abuts against the pivot. The valve has an outer surface, a first surface, a second surface, an axial hole, a ball, a baffle, a circular groove and a radial hole. The first surface abuts against the pivot. The second surface is opposite to the first surface. The axial hole is formed through the valve and has a first opening and a second opening. The first opening is formed on the first surface. The second opening is formed on the second surface. The ball is mounted in the axial hole of the valve. The baffle is mounted on the first opening of the axial hole and has a via hole communicating with the oil chamber and the axial hole. The circular groove is formed around the outer surface of the valve. The radial hole is formed radially in the valve and is in communication with the axial hole and the circular groove. The spring is mounted in the oil chamber of the rotating seat and has a first end and a second end. The first end abuts against the body of the rotating seat. The second end is opposite to the first end and abuts against the second surface of the valve.

The fixing plate of the hydraulic hinge is mounted on a doorframe. The rotating seat is mounted on a glass door. When the glass door is closed to a specific angle, the circular groove of the valve communicates with the second oil passage, and then oil in the oil chamber can flow through the circular groove of the valve, the radial hole of the valve, and further flow out the second surface of the valve. Therefore, the refluxing of oil in the hydraulic hinge is increased to increase the velocity of repositioning the rotating seat and the velocity of closing the glass door. Thus, the velocity of closing the glass door increases gradually from low speed to high speed, such that cool air escaping from the house is reduced. In addition, the valve of the hydraulic hinge is structurally simple, thereby simplifying the manufacturing process.

Other objects, advantages and novel features of the invention will become more apparent from the following detailed description when taken in conjunction with the accompanying drawings.

DETAILED DESCRIPTION OF PREFERRED EMBODIMENT

Figure 1:
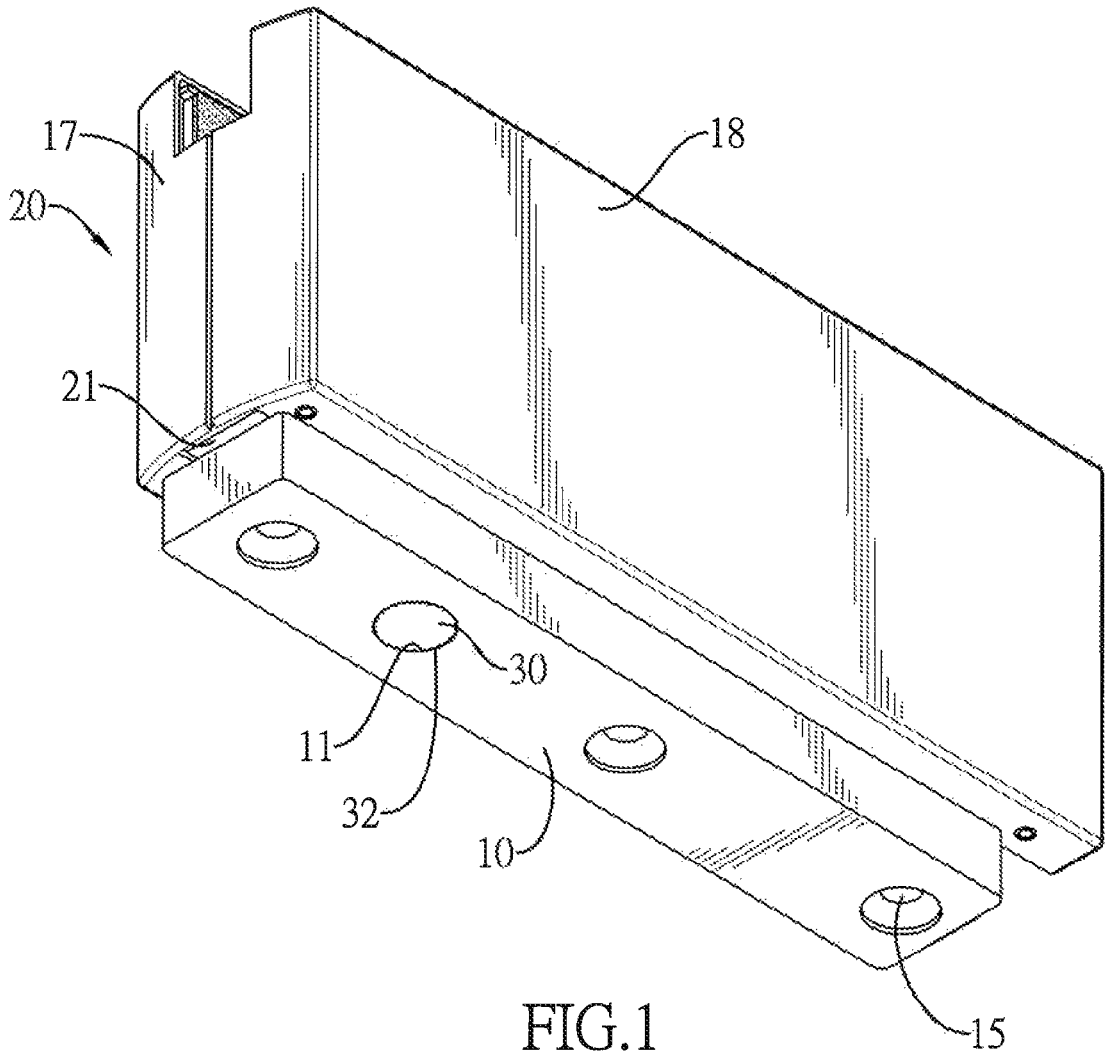
FIG. 1 is a perspective view of a hydraulic hinge for a glass door in accordance with the present invention.
Figure 2:
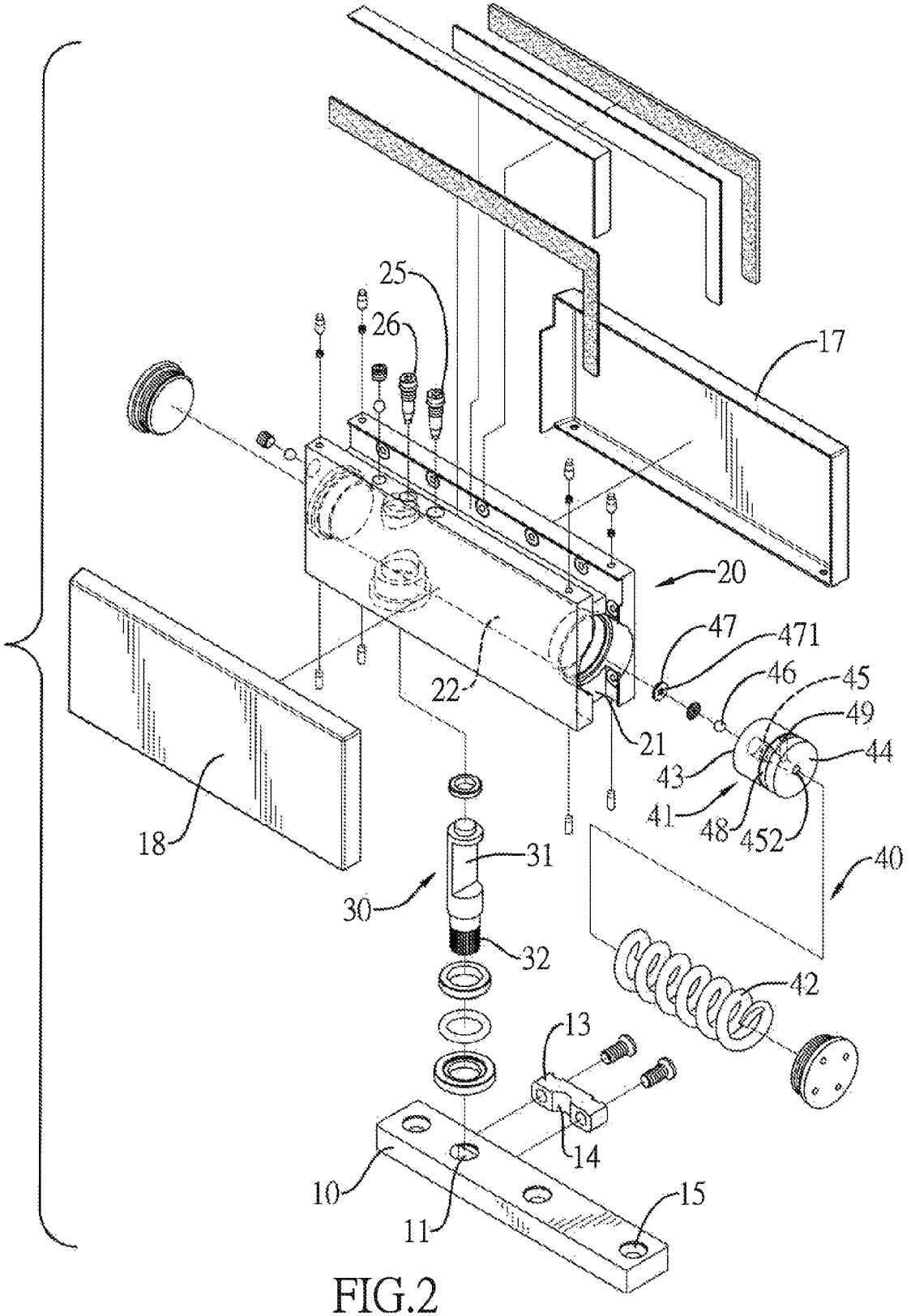
FIG. 2 is an exploded perspective view of the hydraulic hinge in FIG. 1.
Figure 3:
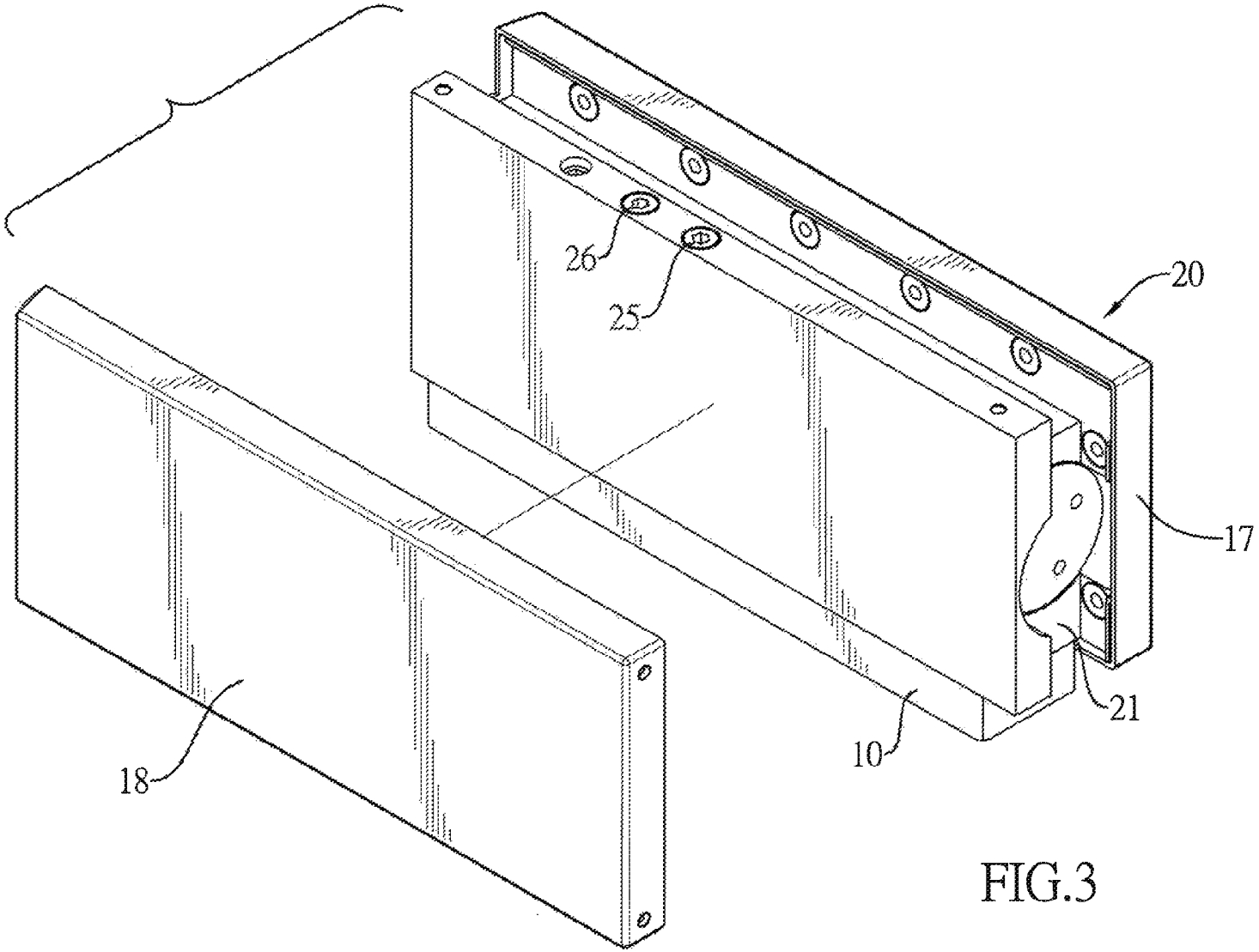
FIG. 3 is another perspective view of the hydraulic hinge in FIG. 1.

With reference to FIGS. 1 to 3, a hydraulic hinge for a glass door in accordance with the present invention comprises a fixing plate 10, a rotating seat 20, a pivot 30 and a buffer module 40.

Figure 7:
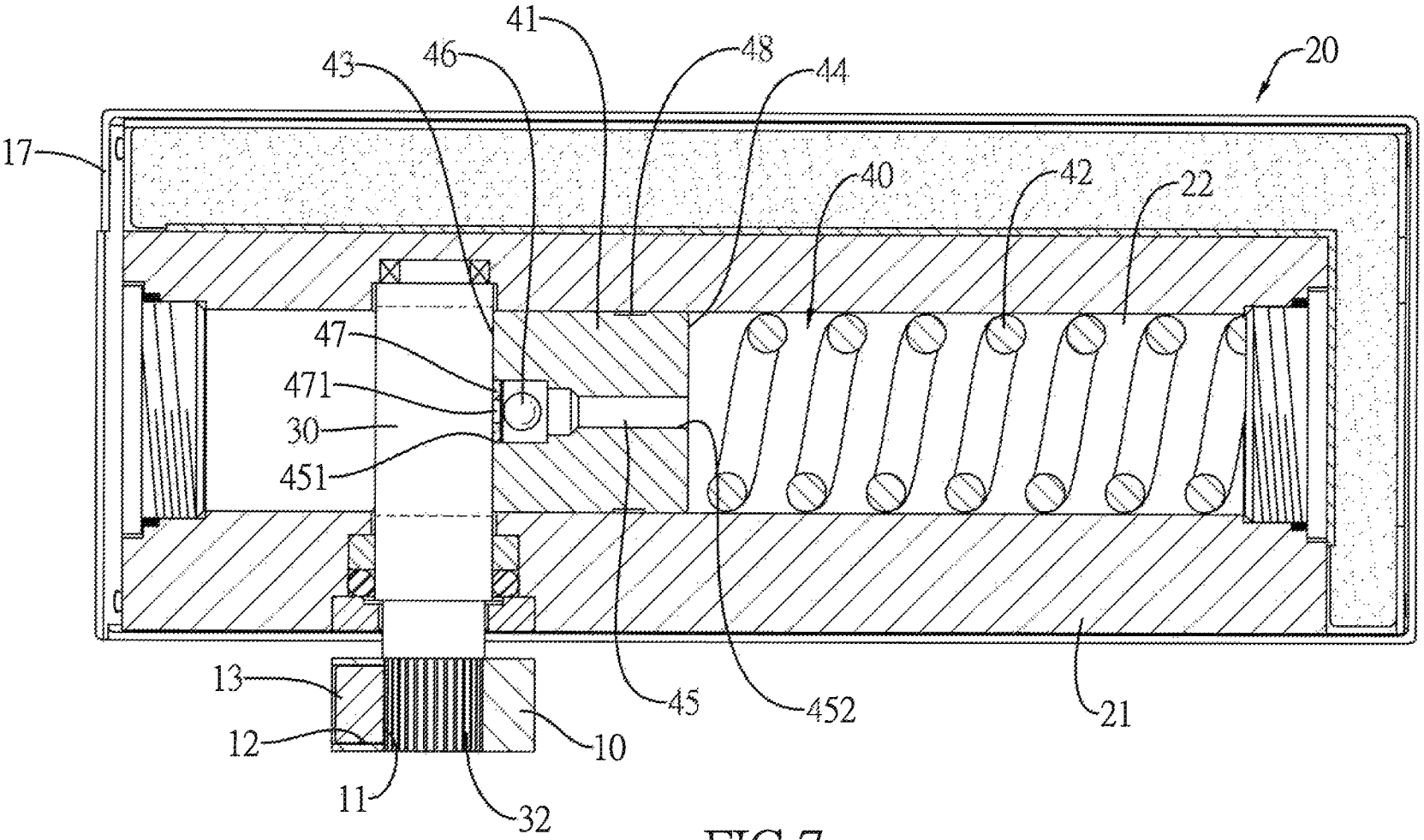
FIG. 7 is a side view in partial section of the hydraulic hinge in FIG. 1, showing the hydraulic hinge actuated.

The fixing plate 10 has a top surface, a side surface, a connecting hole 11, a side opening 12, multiple through holes 15 and a lid 13. The side surface is connected to the top surface. The connecting hole 11 is formed in the top surface and extends through the fixing plate 10. With reference to FIG. 7, the side opening 12 is formed in the side surface of the fixing plate 10 and is in communication with the connecting hole 11. The through holes 15 are formed in the top surface and extend through the fixing plate 10. The lid 13 is mounted in the side opening 12 and has a cambered surface 14.

Figure 10:
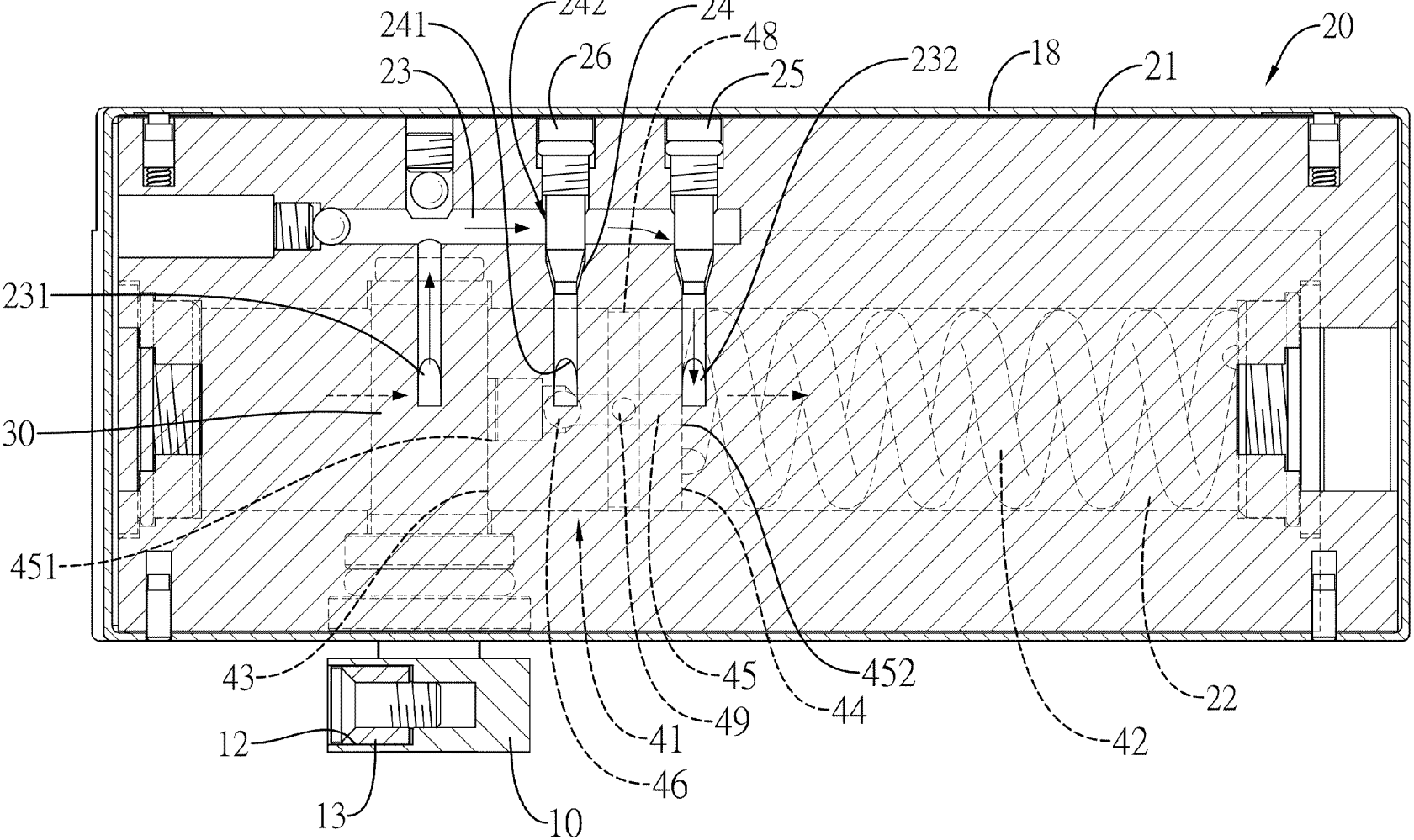
FIG. 10 is a side view in partial section of the hydraulic hinge in FIG. 1 showing a first oil flow path during repositioning of the rotating seat.
Figure 11:
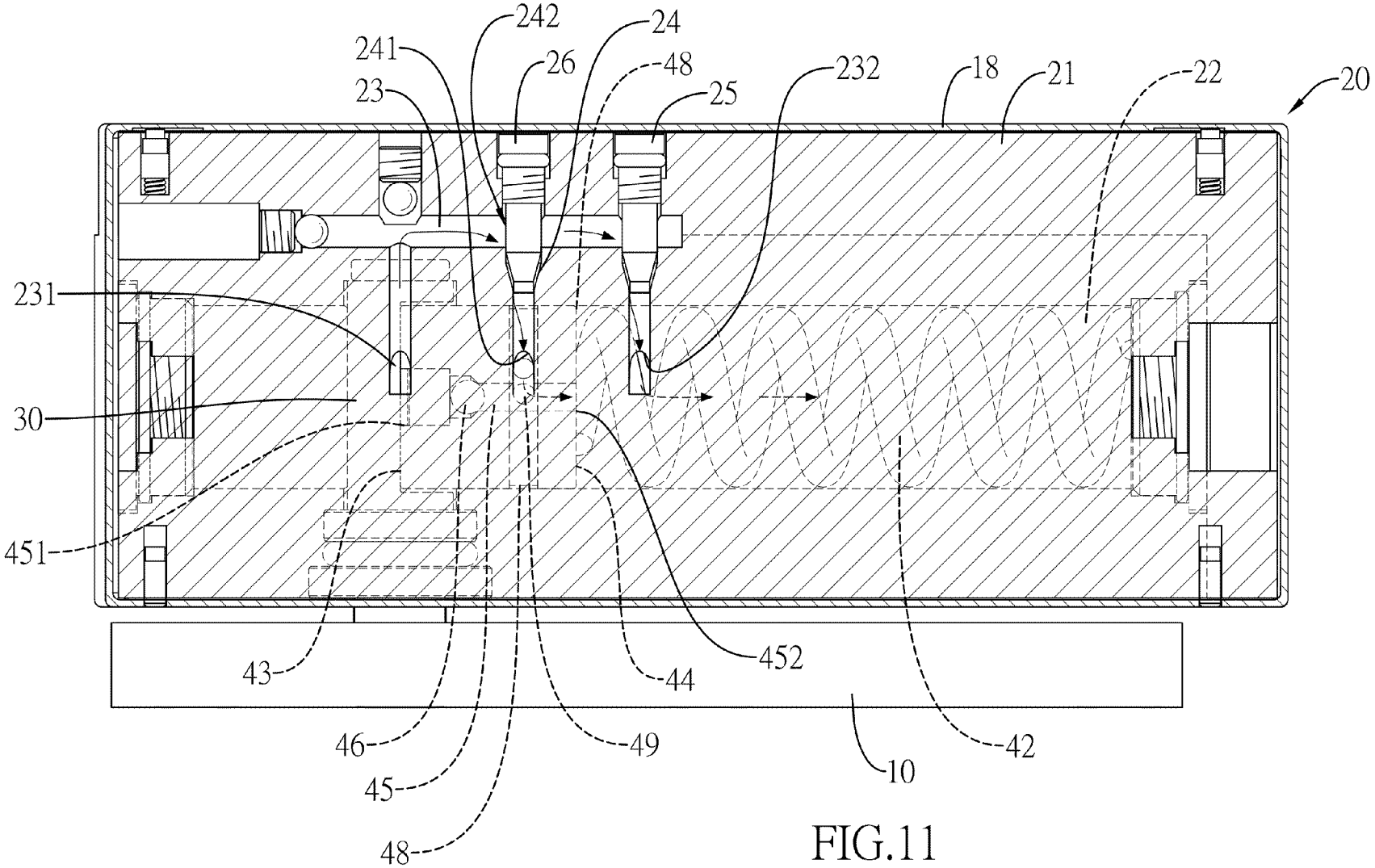
FIG. 11 is a side view in partial section of the hydraulic hinge along line 11-11 in FIG. 9 showing a second oil flow path during repositioning of the rotating seat.

With reference to FIGS. 2, 10 and 11, the rotating seat 20 has a body 21, an oil chamber 22, a first oil passage 23 and a second oil passage 24. The oil chamber 22, the first oil passage 23 and the second oil passage 24 are formed in the body 21 and are filled with oil. The first oil passage 23 has a first inlet 231 and a first outlet 232. The second oil passage 24 has a second inlet 242 and a second outlet 241. The second inlet 242 is in communication with the first oil passage 23. The first inlet 231, the first outlet 232 and the second outlet 241 are in communication with the oil chamber 22. The second outlet 241 is located between the first inlet 231 and the first outlet 232.

Figure 6:
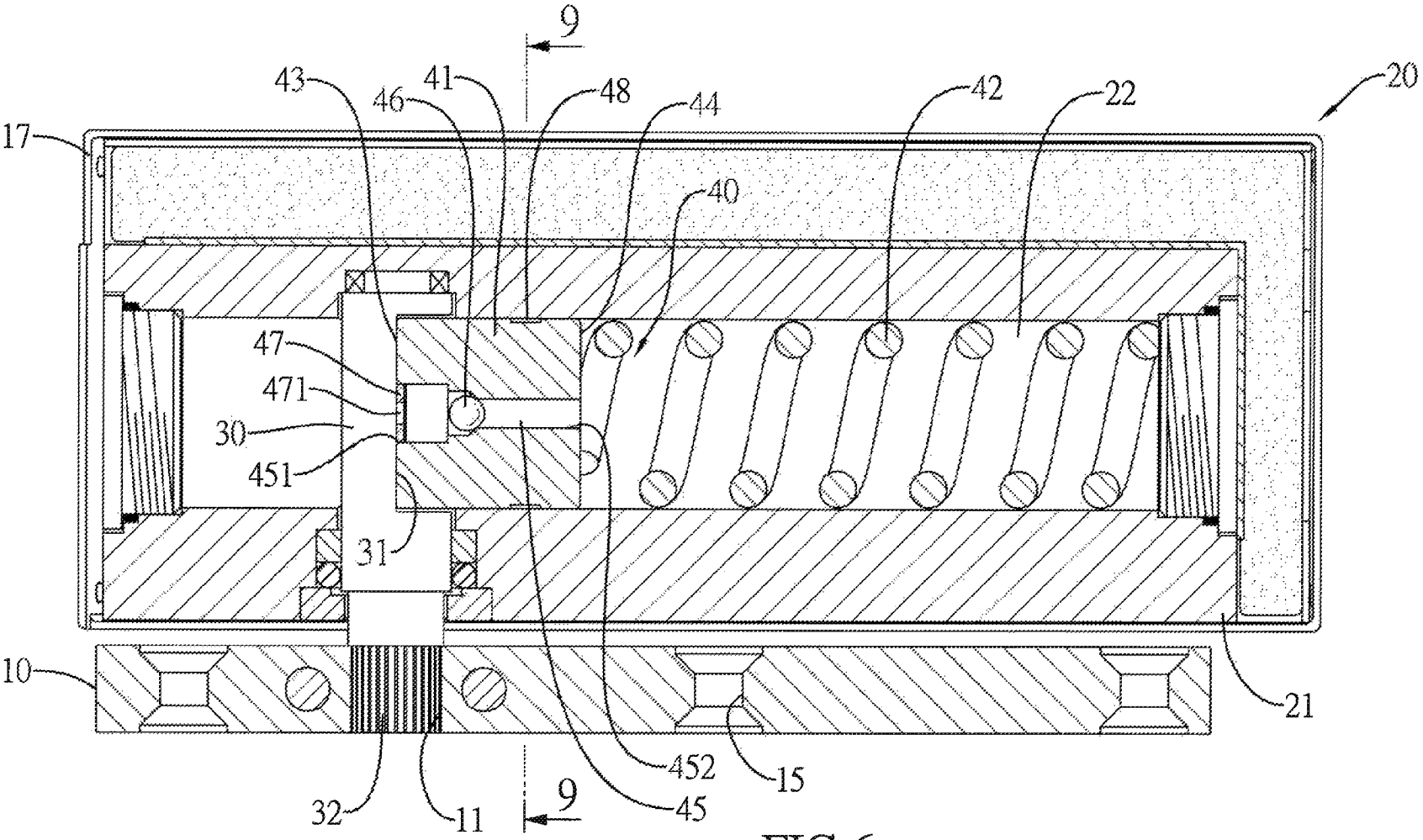
FIG. 6 is a side view in partial section of the hydraulic hinge in FIG. 1, showing the hydraulic hinge unactuated.

With reference to FIGS. 2 and 6, the pivot 30 has a first portion, a second portion, an abutted surface 31 and a toothed part 32. The first portion of the pivot 30 is mounted steadily on the fixing plate 10 and is inserted into the connecting hole 11 of the fixing plate 10. The second portion of the pivot 30 is mounted rotatably into the rotating seat 20. The abutted surface 31 is formed on the pivot 30 and is located in the oil chamber 22 of the rotating seat 20. The toothed part 32 is formed on the first portion of the pivot 30, and the cambered surface 14 of the lid 13 of the fixing plate 10 abuts against the toothed part 32 of the pivot 30.

The buffer module 40 is mounted in the rotating seat 20 and is located in the oil chamber 22 of the rotating seat 20. The buffer module 40 has a valve 41 and a spring 42. The valve 41 is cylindrical and abuts against the pivot 30. The valve 41 has an outer surface, a first surface 43, a second surface 44, an axial hole 45, a ball 46, a baffle 47, a circular groove 48 and a radial hole 49. The first surface 43 abuts against the pivot 30. The second surface 44 is opposite to the first surface 43.

Figure 4:
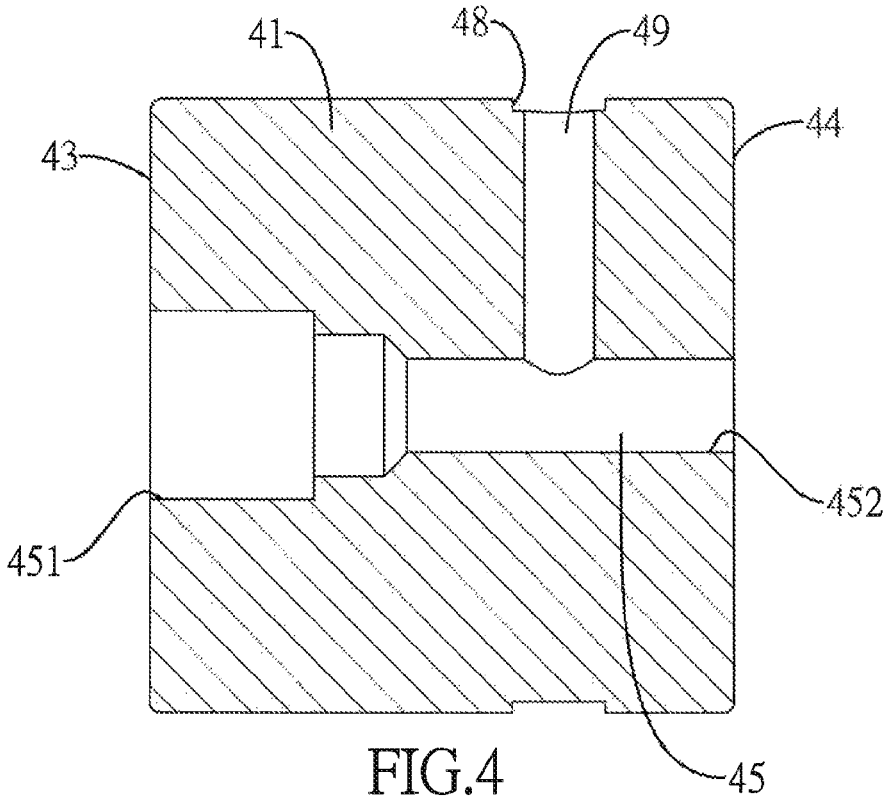
FIG. 4 is an enlarged cross sectional side view of a valve of the hydraulic hinge in FIG. 2.
Figure 5:
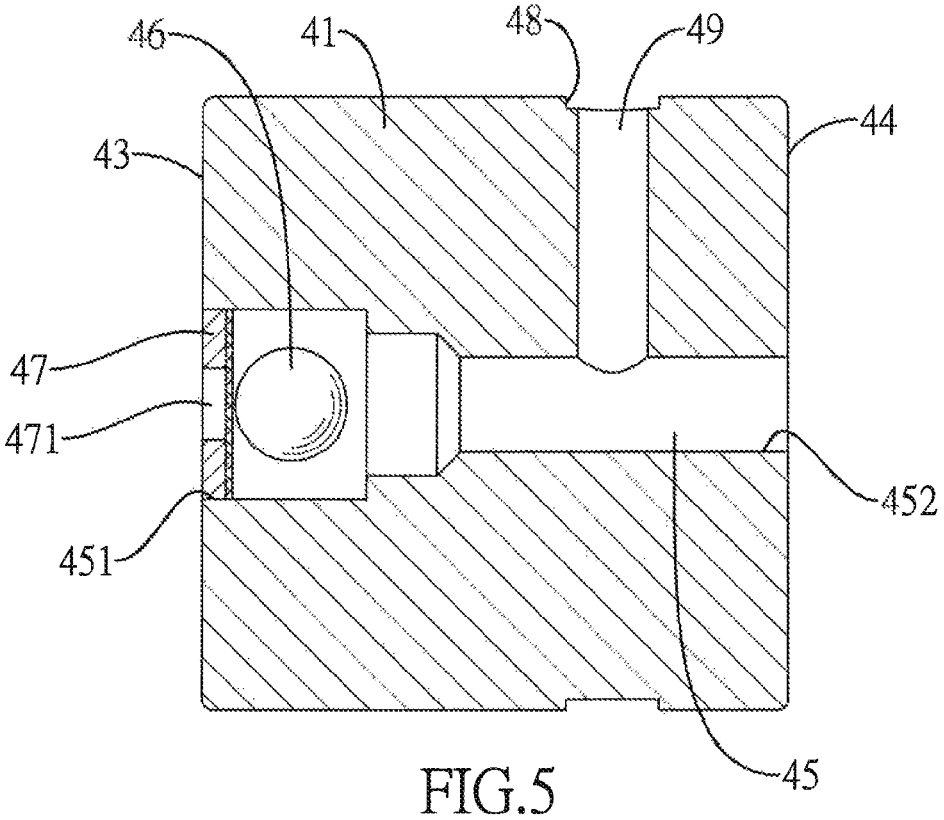
FIG. 5 is a side view in partial section of the valve of the hydraulic hinge in FIG. 4 combined with a ball and a baffle.

With further reference to FIGS. 4 and 5, the axial hole 45 is formed through the valve 41 and has a first opening 451 and a second opening 452. The first opening 451 is formed in the first surface 43 and the second opening 452 is formed in the second surface 44. The ball 46 is mounted in the axial hole 45 of the valve 41. The baffle 47 is mounted in the first opening 451 of the axial hole 45 and has a via hole 471 communicating with the oil chamber 22 and the axial hole 45.

Figure 9:
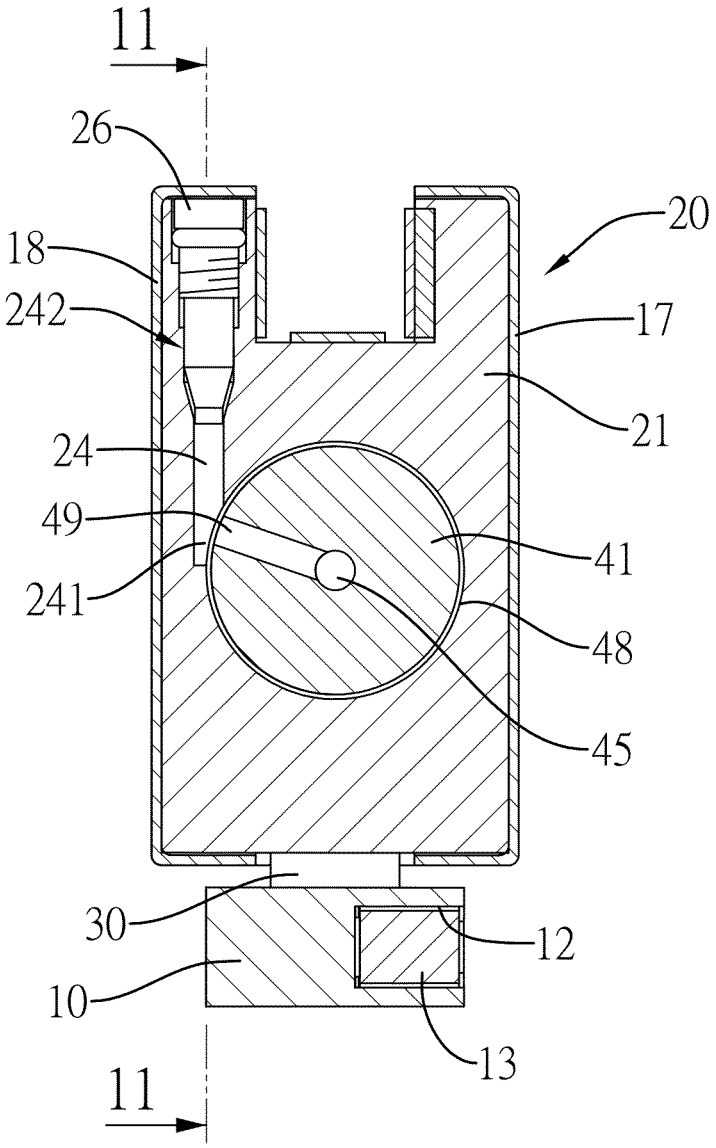
FIG. 9 is a front view in partial section of the hydraulic hinge along line 9-9 in FIG. 6.

With further reference to FIG. 9, the circular groove 48 is formed around the outer surface of the valve 41. The radial hole 49 is formed radially in the valve 41 and is in communication with the axial hole 45 and the circular groove 48.

The spring 42 is mounted in the oil chamber 22 and has a first end and a second end. The first end of the spring 42 abuts against the body 21 of the rotating seat 20. The second end of the spring 42 abuts against the second surface 44 of the valve 41.

With reference to FIGS. 1 and 2, the hydraulic hinge in accordance with the present invention may further have a first cover 17 and a second cover 18. The first cover 17 and the second cover 18 are symmetrically mounted on the body 21 of the rotating seat 20. With reference to FIGS. 10 and 11, the rotating seat 20 further has a first adjustment element 25 and a second adjustment element 26. The first adjustment element 25 is mounted in the body 21 of the rotating seat 20, extends into the first oil passage 23 and faces the first outlet 232. The second adjustment element 26 is mounted in the body 21 of the rotating seat 20, extends into the second oil passage 24 and faces the second outlet 241. With reference to FIG. 6, the oil chamber 22 is divided into a first space and a second space by the valve 41. The first space is located outside the valve relative to the first surface 43 of the valve 41. The second space is located outside the valve relative to the second surface 44 of the valve 41.

Figure 8:
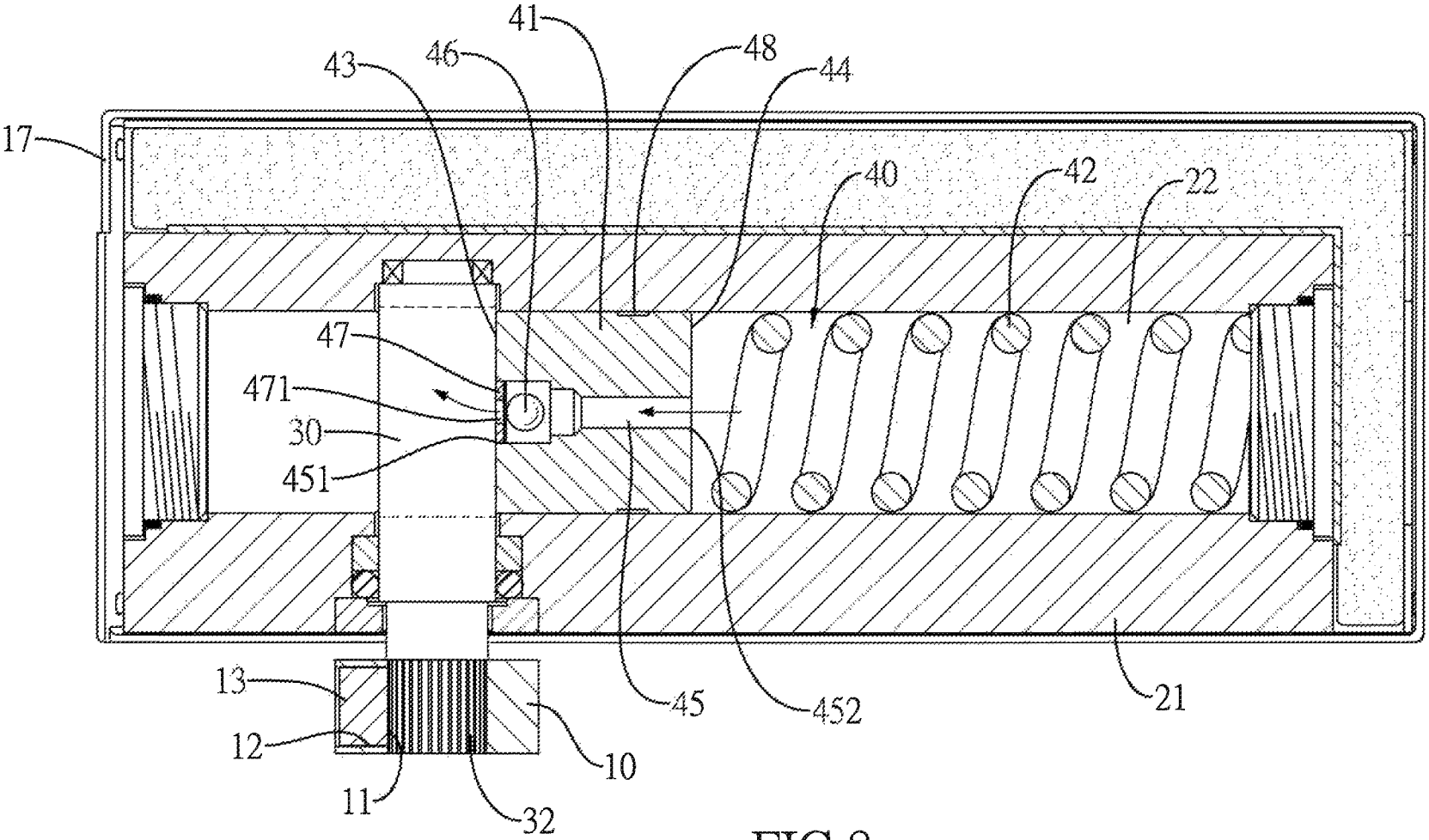
FIG. 8 a side view in partial section of the hydraulic hinge in FIG. 1 showing an oil flow path.
Figure 12:
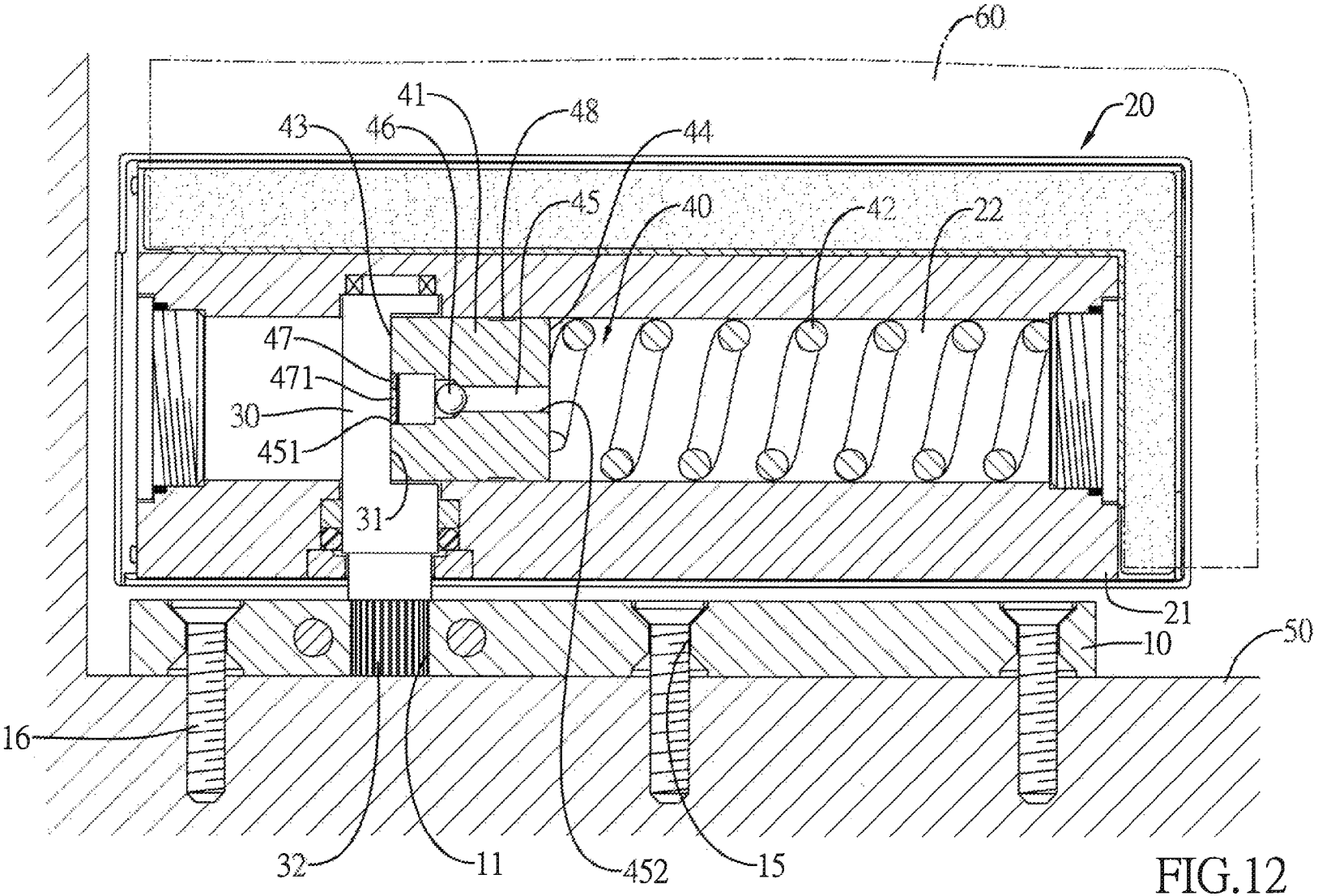
FIG. 12 is an operational side view in partial section of the hydraulic hinge in FIG. 1 combined with a doorframe and a glass door.

With reference to FIG. 12, the fixing plate 10 is mounted on a doorframe by multiple screws 16 that are inserted through the through holes 15 respectively. The rotating seat 20 is mounted on a glass door 60. With reference to FIG. 6, when the glass door 60 is closed, the first surface 43 abuts against the abutted surface 31 of the pivot 30. With reference to FIGS. 7 and 8, when the glass door 60 is open, the rotating seat 20 and the buffer module 40 are pivoted relative to the pivot 30 and the fixing plate 10. The contacted area between the first surface 43 and the abutted surface 31 is reduced, and the valve 41 is moved by the pivot 30 and further presses the spring 42. Accordingly, oil in the second space is compressed and flows into the axial hole 45 of the valve 41 to push the ball 46 and flows through the via hole 471 of the baffle 47 and into the first space.

With reference to FIG. 10, when the glass door 60 is closed, oil in the first space reflows and pushes the ball 46 to close the axial hole 45. Then, oil in the first space flows into the first oil passage 23 of the rotating seat 20 and flows out of the first outlet 232 of the first oil passage 23 and into the second space. The valve 41 is moved toward the pivot 30 by the restoring force of the spring 42. The contacted area between the first surface 43 and the abutted surface 31 is increased, and then the glass door 60 is closed slowly.

When the glass door 60 is closed to a specific angle, a passage between the grass door 60 and the doorframe 50 cannot provide enough space for users to pass through. With reference to FIGS. 9 and 11, when the valve 41 is moving a distance, the circular groove 48 of the valve 41 is in communication with the second oil passage 24 of the rotating seat 20. Oil in the first space further flows into the second oil passage 24 via the first oil passage 23. Then, oil passes through the second outlet 241 of the second oil passage 24, the radial hole 49 of the valve 41, and the axial hole 45 of the valve 41, and then flows into the second space to increase the refluxing of oil flowing into the second space. Thus, the velocity of closing the glass door 60 gradually increases from low speed to high speed.

If the combination positions of the hydraulic hinge and the glass door 60 are offset from each, the lid 13 of the fixing plate 10 can be disassembled for adjusting the pivot 30. When the adjustment of the pivot 30 is finished, the lid 13 of the fixing plate 10 can be reassembled and the toothed part 32 of the pivot 30 abuts against the cambered surface 14 of the lid 13 for increasing the combination stability between the pivot 30 and the fixing plate 10. Furthermore, the amount of oil flowing out of the first outlet 232 is controlled by the first adjustment element 25, and the amount of oil flowing out the second outlet 241 is controlled by the second adjustment element 26.

Accordingly, the circular groove 48 of the valve 41 communicates with the second oil passage 24 when the glass door 60 is closed to a specific angle, and then oil can flow through the circular groove 48 of the valve 41, the radial hole 49 of the valve 41, and further flow into the second space. Therefore, the refluxing of oil in the hydraulic hinge is increased, and the velocity of repositioning the rotating seat and the velocity of closing the glass door 60 are increased. Thus, the velocity of closing the glass door 60 gradually increases from low speed to high speed for reducing the cool air escaping from the house. In addition, the valve 41 of the hydraulic hinge is structurally simple, thereby simplifying the manufacturing process.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the teiins in which the appended claims are expressed.

What is claimed is:

1. A hydraulic hinge for a glass door comprising:
- a fixing plate;
- a rotating seat having
  - a body;
  - an oil chamber formed in the body;
  - a first oil passage formed in the body and having
    - a first inlet communicating with the oil chamber; and
    - a first outlet communicating with the oil chamber;
  - a second oil passage formed in the body and having
    - a second inlet communicating with the first oil passage; and
    - a second outlet communicating with the oil chamber and located between the first inlet and the first outlet;
- a pivot combined with the fixing plate and the rotating seat, and having
  - a first portion mounted steadily on the fixing plate;
  - a second portion mounted rotatably into the rotating seat; and
  - an abutted surface formed on the pivot and located in the oil chamber of the rotating seat; and
- a buffer module mounted in the rotating seat, located in the oil chamber of the rotating seat and having
  - a cylindrical valve abutting against the pivot and having
    - an outer surface;
    - a first surface abutting against the pivot;
    - a second surface opposite to the first surface;
    - an axial hole formed through the cylindrical valve and having
      - a first opening formed in the first surface; and
      - a second opening formed in the second surface;
    - a ball mounted in the axial hole of the cylindrical valve;
    - a baffle mounted in the first opening of the axial hole and having a via hole communicating with the oil chamber and the axial hole;
    - a circular groove formed around the outer surface of the cylindrical valve, wherein the circular groove is connected with the second oil passage when the cylindrical valve is moved to a specific position; and
    - a radial hole formed radially in the cylindrical valve and communicating with the axial hole and the circular groove; and
  - a spring mounted in the oil chamber of the rotating seat and having
    - a first end abutting against the body of the rotating seat; and
    - a second end abutting against the second surface of the cylindrical valve.

2. The hydraulic hinge as claimed in claim 1, wherein
- the pivot has a toothed part formed on the first portion of the pivot; and
- the fixing plate has
  - a lid having a cambered surface abutting against the toothed part of the pivot.

3. The hydraulic hinge as claimed in claim 1, wherein
- the rotating seat has
  - a first adjustment element mounted in the body of the rotating seat, extending into the first oil passage and facing the first outlet; and
  - a second adjustment element mounted in the body of the rotating seat, extending into the second oil passage and facing the second outlet.

4. The hydraulic hinge as claimed in claim 2, wherein
- the rotating seat has
  - a first adjustment element mounted in the body of the rotating seat, extending into the first oil passage and facing the first outlet; and
  - a second adjustment element mounted in the body of the rotating seat, extending into the second oil passage and facing the second outlet.

5. The hydraulic hinge as claimed in claim 1, wherein the hydraulic hinge has a first cover and a second cover symmetrically mounted on the rotating seat.

6. The hydraulic hinge as claimed in claim 2, wherein the hydraulic hinge has a first cover and a second cover symmetrically mounted on the rotating seat.

7. The hydraulic hinge as claimed in claim 3, wherein the hydraulic hinge has a first cover and a second cover symmetrically mounted on the rotating seat.

8. The hydraulic hinge as claimed in claim 4, wherein the hydraulic hinge has a first cover and a second cover symmetrically mounted on the rotating seat.

* * * * *